United States Patent [19]

Kitamura

[11] Patent Number: 4,575,347

[45] Date of Patent: Mar. 11, 1986

[54] TOY MUSIC BOX

[75] Inventor: Yoshio Kitamura, Nagano, Japan

[73] Assignee: Kabushiki Kaisha Sankyo Seiki Seisakusho, Nagano, Japan

[21] Appl. No.: 590,620

[22] Filed: Mar. 19, 1984

[30] Foreign Application Priority Data

Aug. 31, 1983 [JP] Japan ..... 58-134520[U]

[51] Int. Cl.[4] ..... A63H 3/28; A63H 3/40

[52] U.S. Cl. ..... 446/301; 446/348

[58] Field of Search ..... 84/94, 94 C, 95, 95 C, 84/96; 446/190, 301, 297, 298, 299, 300, 302, 303, 315, 323, 341, 343, 345, 348, 349, 350, 397, 404, 420, 409, 227, 338

[56] References Cited

U.S. PATENT DOCUMENTS

| | | | |
|---|---|---|---|
| Re. 18,585 | 8/1932 | Konoff | 446/348 |
| 3,287,848 | 11/1966 | Katz et al. | 446/338 X |
| 3,358,400 | 12/1967 | Katz et al. | 446/338 |
| 3,364,618 | 1/1968 | Ryan et al. | 446/301 X |
| 3,455,052 | 7/1969 | Gardel et al. | 446/338 |
| 3,495,351 | 2/1970 | Bear et al. | 446/301 |
| 3,550,315 | 12/1970 | Samo | 446/343 |
| 3,664,059 | 5/1972 | Leibowitz | 446/343 |
| 4,050,342 | 9/1977 | Suzuki et al. | 84/94 C |

FOREIGN PATENT DOCUMENTS

| | | | |
|---|---|---|---|
| 793223 | 4/1958 | United Kingdom | 446/298 |
| 1584796 | 2/1981 | United Kingdom | 446/190 |

*Primary Examiner*—Robert A. Hafer
*Assistant Examiner*—D. Neal Muir
*Attorney, Agent, or Firm*—Sughrue, Mion, Zinn, Macpeak & Seas

[57] ABSTRACT

A toy music box having eyes which are oscillated back and forth for which distance between the eyes can be varied to make the device usable with different casings. A control plate which effects oscillatory movement of the eyes is provided with first and second pairs of engaging pins on one surface thereof, with the distance between the engaging pins corresponding to two possible distances between the eyes for two different casings. The orientation of the control plate is chosen so that the appropriate pair of engaging pins is engaged with the corresponding eyes for the respective eye spacing.

10 Claims, 23 Drawing Figures

TOY MUSIC BOX

BACKGROUND OF THE INVENTION

The present invention relates to a music box for a toy.

In one well-known type of toy, the toy includes a face imitative of an animal or human face and having movable eyes. The eyes are moved back and forth by power derived from a music box provided inside the case of the toy. Particularly, the eyes undergo a synchronized back-and-forth movement. To effect this movement, a reciprocatable control plate is connected between the movable eyes and the music box, with the control plate being moved back and forth by the music box to reciprocate the eyes accordingly.

The movable eye design is desirably employed in a plurality of different types of toys. Specifically, it is desirable to use a single eye mechanism with toys having different face shapes, and specifically, different distances between the eyes. However, the prior art eye moving mechanism was capable of being used with only a single eye spacing. That is, if it is desired to change the eye spacing, a different mechanism has to be designed. This is due primarily to the fact that the control plate of the prior art structure could not be used in the case that the eye spacing was changed. An example of such a prior art structure is disclosed in Japanese Utility Model Publication No. 3358/1982.

Further, the prior art structure was disadvantageous in that, if the size of the casing halves enclosing the music box and eye moving mechanism was changed, the angle through which the eyes could be reciprocated was changed. Furthermore, if the depth of the case was changed, the driving system coupling the music box to the eye moving mechanism had to be redesigned.

Accordingly, it is an object of the present invention to overcome the drawbacks of the prior art structure.

Specifically, it is an object of the present invention to provide a music box for a toy having movable eyes which can be used in a plurality of different applications, namely, where the distance between the eyes is changed and where the dimensions of the casing are changed.

SUMMARY OF THE INVENTION

In accordance with the invention, the above and other objects are met by providing a mechanism for a toy music box of a type having movable eyes in which at least two pairs of engaging members spaced at different pitches are provided on a control plate, and movable parts, specifically, the eyes, have symmetrical rotary shafts and have grooved tongues engaged with one of the two pairs to oscillate the eyes by the reciprocating motion of the control plate. By placing the control plate either right side up or upside down, the spacing between the eyes can be changed.

DESCRIPTION OF THE PREFERRED EMBODIMENTS

Figure 1:
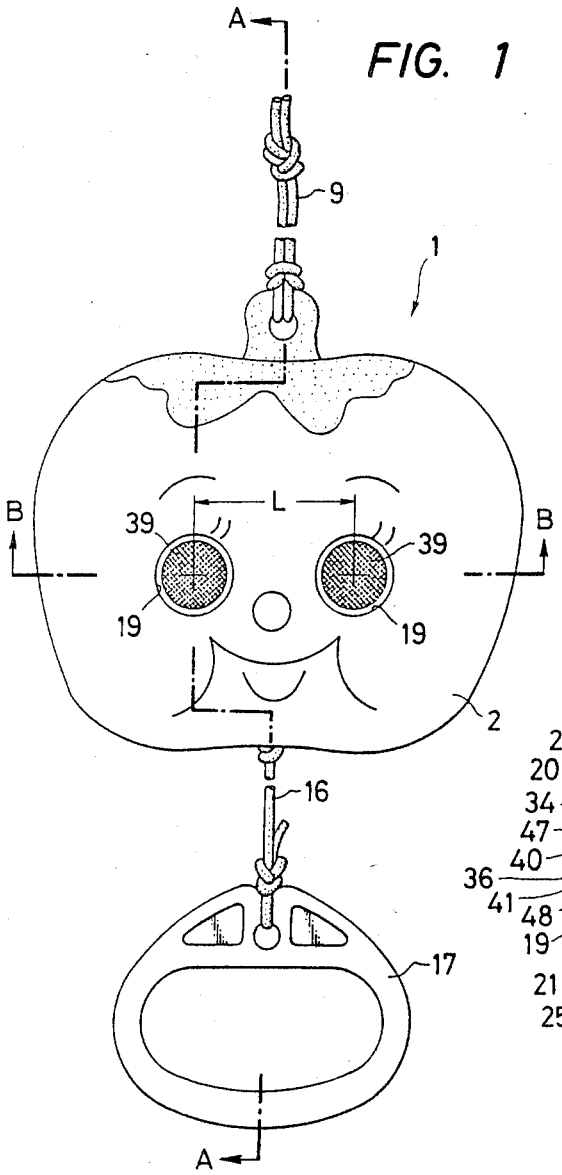
FIG. 1 is a front view of a toy music box of the invention.

The invention will now be described in detail with reference to the drawings.

In FIGS. 1 through 4, reference numeral 1 indicates the overall toy music box. The toy music box has a casing composed of a front half 2 and a rear half 3. An eye moving mechanism 4 and a music box mechanism 5 are housed within the casing. The front half 2 and the rear half 3 of the casing have mating open edges, and the two halves are held together by screws 8. A string 9 is secured to the upper part of the housing and is used to suspend the toy from a hook or the like.

The music box mechanism 5 may be of the well-known type, including a frame 10, a drive spring assembly 11, a drum 12 having projections extending from the surface thereof in a pattern determined by the tune to be played, a sounding plate 13 having forks of various lengths placed adjacent to the drum 12 for sounding the tune, a governor mechanism (not shown) and the like. The frame 10 is secured to the rear half 3 of the casing by screws 14. A pulley 15 is secured to a spring winding shaft of the drive spring assembly 11. Several turns of a spring winding string 16 are wound around the pulley 15, while the other end of the string 16 passes out through an opening in the rear half 3 and is attached to a ring 17. A secondary gear 18 is fixed to one end of the drum 12.

The eye moving mechanism 4 will now be described. In the front half 2 of the casing are formed a pair of eyeholes 19. A pair of horizontally extending walls 20 and 21 and a pair of vertically extending walls 22 and 23 frame the holes 19. Pairs of bearing notches 24 and 25 are formed in corresponding walls 20 and 21. The distance between the notches 24 and 25 of each pair is equal to the distance L between the eyeholes 19. A support post 28 projects rearwardly between the eyeholes 19. The edges 29 and 30 of the walls 20 and 21, respectively, lie in a plane slightly forward of a plane defined by the edges 31 and 32 of the walls 22 and 23, respectively.

Figure 22:
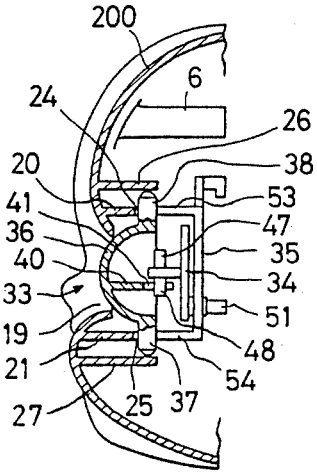
FIG. 22 is a cross-sectional view taken along a line F—F in FIG. 21.

Movable members in the form of imitation eyes 33 are supported by the bearing notches 24 and 25. More specifically, with reference to FIGS. 3 and 15 through 20, each eye 33 includes an eye body 36 having an upper shaft 37 a lower shaft 38 projecting upwardly and downwardly therefrom. The shafts 37 and 38 have the same length. The eye body 36 has the shape of a hollow hemisphere having an eye pattern 39 painted on the outer surface thereof. A tongue 40 extends rearwardly from the eye body 36 in a plane perpendicular to the axes of the shafts 37 and 38 in the direction of the shaft 37. An engaging groove 41 is formed in the tongue 40 in alignment with the shafts 37 and 38. Projections 42 are formed on the outer surface of the eye body 36 on the side of the shaft 37. It is the purpose of the projections 42 to indicate the upper and lower sides of the eye. The rotary shafts 37 and 38 are rotatably fitted in the notches 24 and 25 as indicated in FIG. 22.

Figure 14:
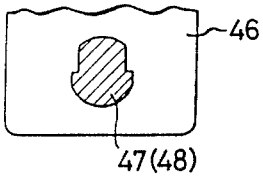
FIG. 14 shows an enlarged plan view of an engaging portion of the control plate.
Figure 15:
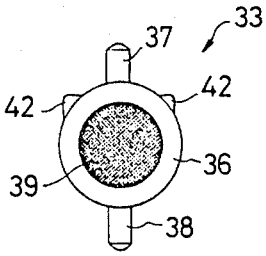
FIG. 15 is a front view of an eye member.
Figure 16:
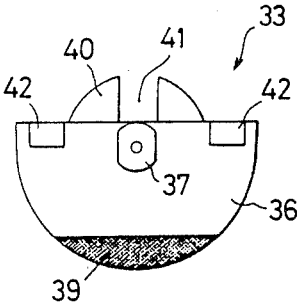
FIG. 16 shows an enlarged plan view of the eye member.
Figure 17:
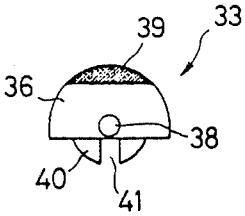
FIG. 17 shows a bottom view of the eye member.
Figure 18:
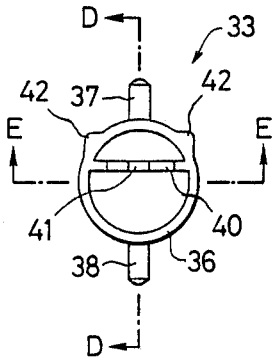
FIG. 18 shows a rear view of the eye member.
Figure 19:
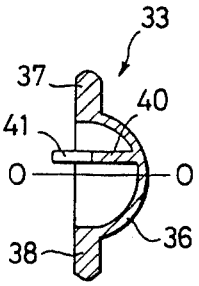
FIG. 19 is a cross-sectional view taken along a line D—D in FIG. 18.
Figure 20:
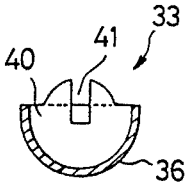
FIG. 20 is a cross-sectional view taken along a line E—E in FIG. 18.

The structure of the control plate 34 will now be described with reference to FIGS. 3 and 11 through 13. Linear projections 43 and 44 are formed at corner portions of the front surface of the control plate 34 which slide upon the aforementioned edges 31 and 32. An elongated hole 45 is formed in the center of the control plate 34 through which the support post 28 slidably projects. Further, a pair of projections 46 are affixed to the front surface of the control plate 34, lying in a plane orthogonal to the plane of the control plate 34 and extending in the direction of reciprocation of the control plate 34. Similarly, linear projections 49 and 50 are formed on the rear surface of the control plate 34 at positions opposite the projections 43. On the upper side of the projections 46 are affixed engaging pins 47, extending in the direction parallel to the rotary shafts 37 and 38 of the eyes 33. The distance $L_1$ between the pins 47 is equal to the distance L between the centers of the eyeholes 19 (see FIG. 1). Second engaging pins 48 are affixed to the lower sides of the projections 46. The distance $L_2$ between the second pins 48 is, in the illustrated embodiment, smaller than the distance $L_1$ between the first pins 47. The diameters of the pins 47 and 48 should be slightly less than the width of the engaging grooves 41. The preferred cross-sectional shape of the pins 47 and 48 is as indicated in FIG. 14.

Next, the construction of the holder plate 35 will be described with reference to FIG. 3 and 7 through 10. A pair of parallel flanges 53 and 54 extend forwardly from the upper and lower edges of the holder plate 35. The flanges 53 and 54 ride upon the edges 29 and 30 of the walls 20 and 21, respectively, of the front half 2 of the casing. The edges of the flanges 53 and 54 serve to hold the shafts 37 and 38 in place in the notches 24 and 25. Linear projections 55 and 56 are formed on the front surface of the holder plate 35 at the edges extending orthogonal to the flanges 53 and 54. The liner projections 49 and 50 ride upon the linear projections 55 and 56, while upper and lower extensions 57 and 58 hold the control plate 34 in place with respect to the holder plate 35. A shaft 60, integral with the front surface of the holder plate 35, is attached to the support post 28 of the front half 2 of the casing with a screw 59. A pair of elongated holes 61 and 62 are formed in the holder plate 35 through which pass pins 51 and 52, respectively, affixed to the rear surface of the control plate 34. A torsion spring 63 is fitted around a post 64 projecting from the upper rear edge of the holder plate 35. One arm 68 of the spring 63 abuts against a hook-like spring stop 65 at the center of the rear surface of the holder plate 35, while the other end 67 of the spring 63 abuts against the pin 52 riding upon a guide 62. Thus, the holder plate 35 is biased leftwardly as viewed in FIG. 3.

Figure 6:
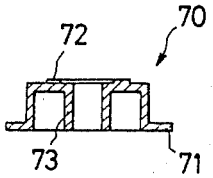
FIG. 6 is a cross-sectional view of a cam gear.
Figure 7:
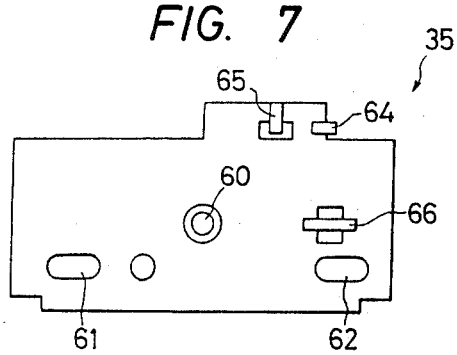
FIG. 7 is a rear view of the holder plate of FIG. 5.
Figure 8:
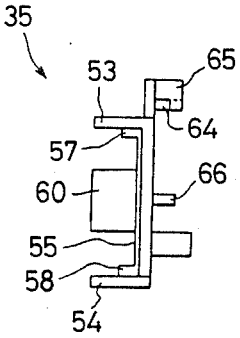
FIG. 8 is a side view of the holder plate of FIG. 5.
Figure 9:
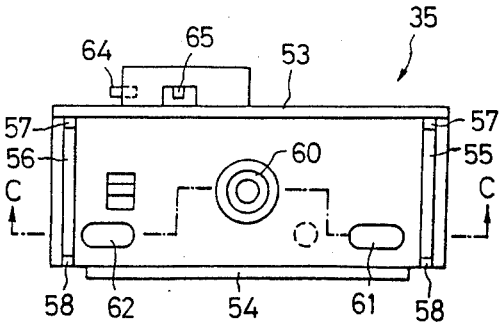
FIG. 9 is a front view of the holder plate of FIG. 5.
Figure 10:
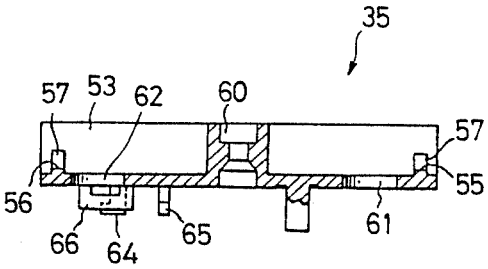
FIG. 10 is a cross-sectional view taken along a line C—C in FIG. 9.
Figure 11:
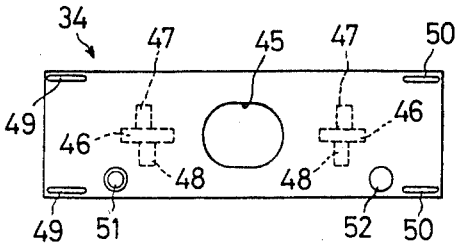
FIG. 11 shows a back view of the control plate of FIG. 5.
Figure 12:
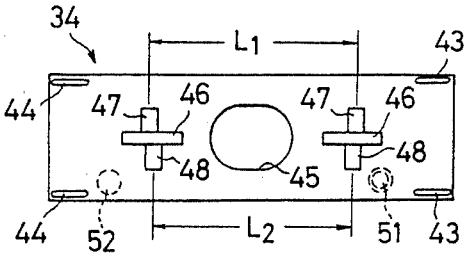
FIG. 12 shows a front view of the control plate of FIG. 5.
Figure 13:
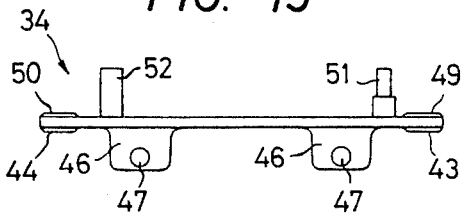
FIG. 13 shows a plan view of the control plate of FIG. 5.

A shaft 69 projects from the lower rear side of the holder plate 35 upon which is rotatably supported a cam gear 70. As shown in FIG. 6, the cam gear 70 has a cam surface 71, a crown gear 72 and a boss 73. The cam surface 71 has four large diameter portions and four small diameter portions. The pin 51, which acts as a cam follower, rides upon this cam surface 71. A coil spring 74 is placed around the boss 73 which urges the cam gear 70 in the direction which would pull it off the shaft 69.

Figure 2:
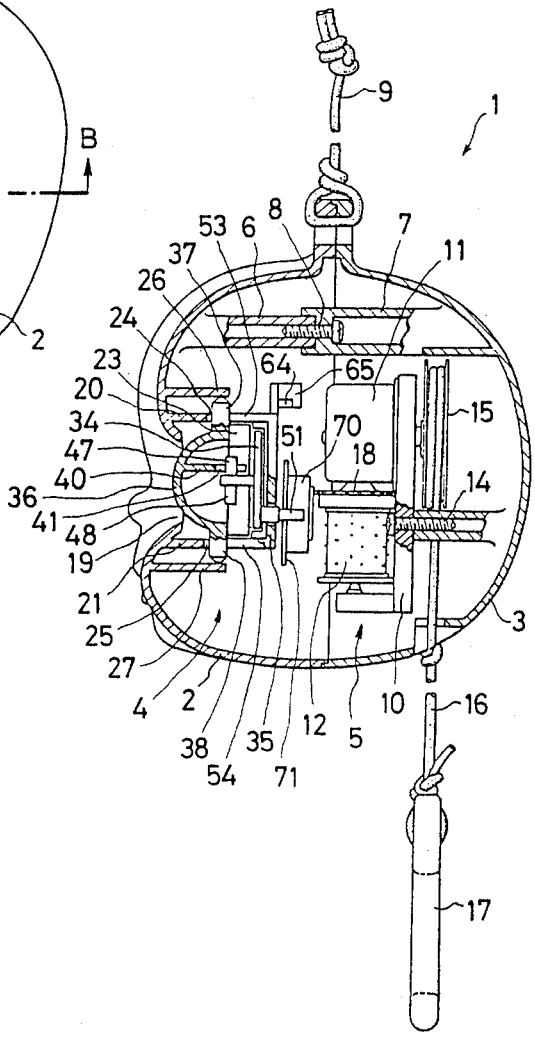
FIG. 2 is a cross-sectional view taken along a line A—A in FIG. 1.

The assembled music box toy will now be described in more detail with reference to FIG. 2 through 4. With the distance between the centers of the eyeholes 19 being L as illustrated, the eyes 33 are assembled in the front half 2 of the casing as indicated in FIG. 2. More specifically, the rotary shafts 37 and 38 are engaged in the notches 24 and 25, while the tongue 40 of the eye body 36 is positioned above the center of the eye body. Accordingly, the projections 42 are on the upper half of the eyes 33. The first (upper) pins 47 of the control plate 34 are fitted into the grooves 41 in the tongues 40 of the eyes 33. The holder plate 35 is secured to the front half 2 of the casing by a screw 59 as mentioned above. In this state, the cam follower pin 51 and the pin 52 attached to the contol plate 34 project through the elongated holes 61 and 62, extending through and beyond the holder plate 35. The flange 53 abuts against the upper edge 29 of the wall 20 and the flange 54 abuts against the edge 30 of the wall 21. The linear projections 49 and 50 on the rear surface of the control plate 34 ride upon the projections 55 and 56 of the holder plate 35 to provide rear support for the control plate 34 and to permit it to slide relative to the holder plate 35.

Figure 3:
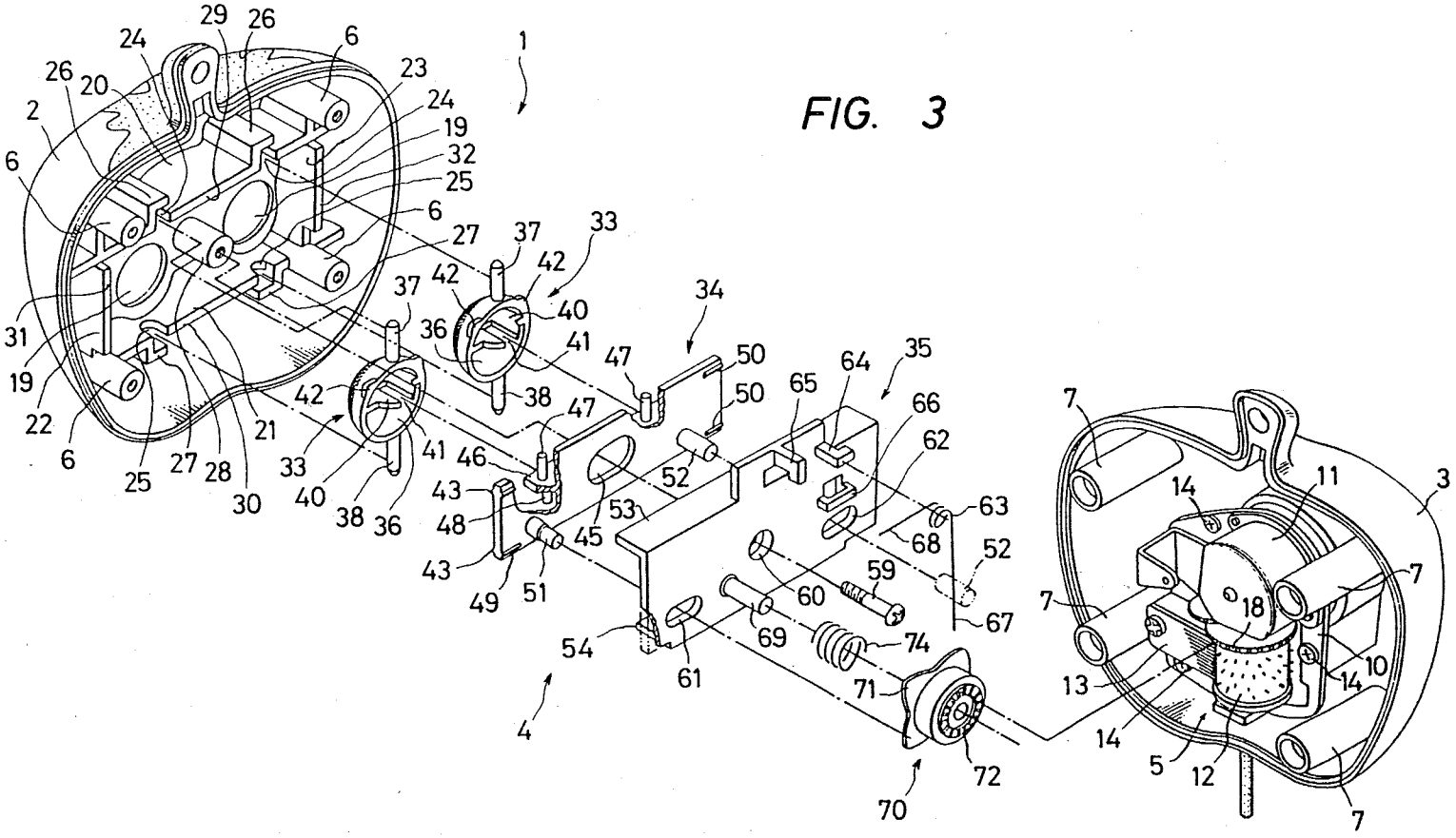
FIG. 3 shows a disassembled perspective view of the mechanism of the invention.
Figure 4A:
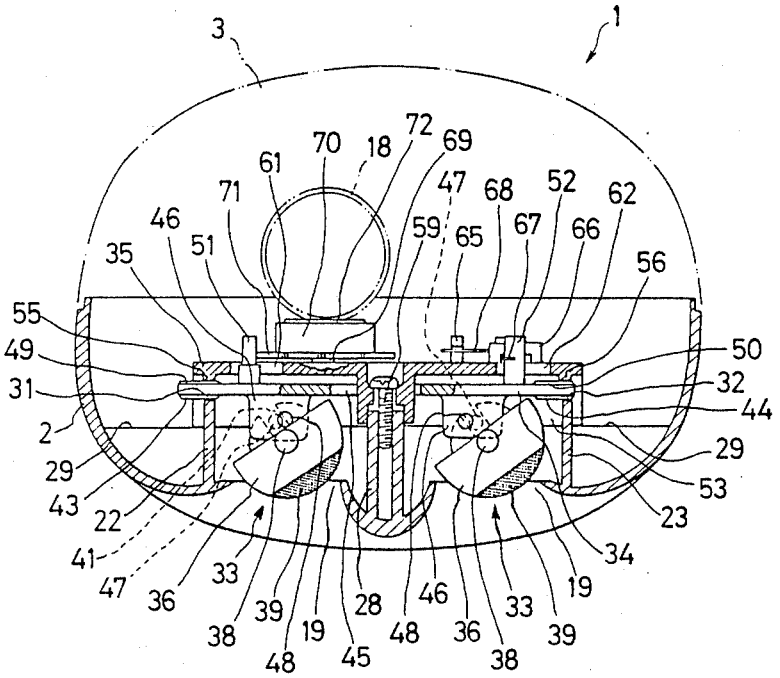
FIG. 4A and 4B are enlarged cross-sectional views taken along a line B—B in FIG. 1.
Figure 4B:
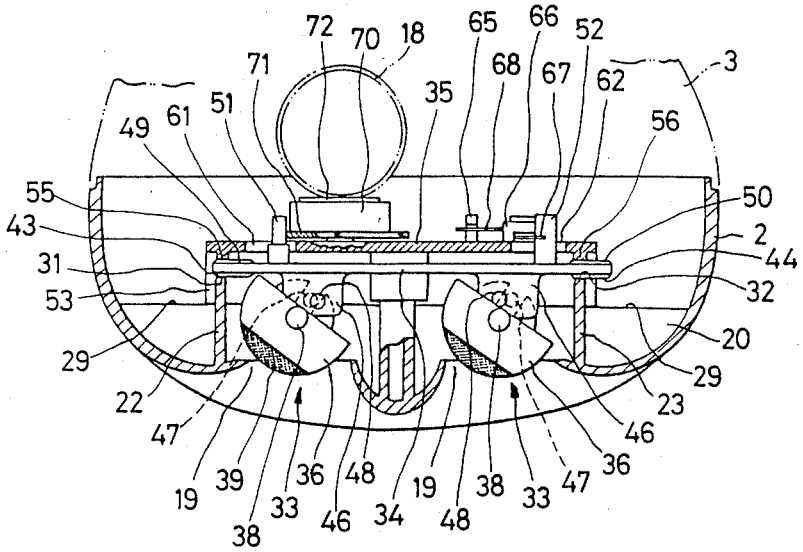
Figure 5:
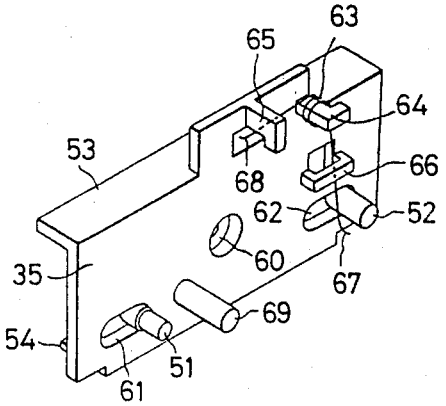
FIG. 5 is a perspective view showing a control plate and a holder plate engaged with one another.

As shown in FIG. 5, and as mentioned above, the end 67 of the spring 63 engages with the pin 52 to bias the holder plate 35 leftwardly as viewed in FIG. 3. Accordingly, as the cam gear 70 is rotated, the cam follower pin 51 of the control plate 34 rides along the cam surface 71 of the cam gear 70, thereby reciprocating the control plate 34 and hence oscillating the eyes 33. The angle through which the eyes 33 are oscillated is determined by the relative values of the torque output of the drive spring of the music box mechanism 5 and the spring constant of the spring 63. Specifically, the stiffer the spring 63 (for a fixed torque output of the music box mechanism 5), the narrower will be the angle through which the eyes 33 is oscillated. Therefore, when the drive spring of the music box mechanism 5 winds down, the eyes 33 will be stopped near the center position thereof.

The assembly of the music box of the invention will now be described. The front half 2 and the rear half 3 of the casing are held together by screws 8. When the front half 2 and the rear half 3 are assembled, an output gear 18 of the music box mechanism 5 meshes with the crown gear 72. Engagement between the gears 18 and 72 is maintained by the coil spring 74. Accordingly, even though the length between the front half 2 and the rear half 3 may vary, engagement between the gears 18 and 70 is maintained.

To wind the music box, the winding string 16 is pulled downwardly. As the string 16 is pulled by means of the ring 17, the pulley 15 is rotated to wind up the drive spring of the drive spring assembly 11. When the winding string 16 is released, the music box is powered by the drive spring assembly 11, resulting in rotation of the drum 12 and the playing of the tune encoded by means of the projections on the drum 12. The speed of rotation of the drum 12 is maintained constant by a governor (not shown). The gear 10 of the drum 12 rotates the cam gear 70, which in turn reciprocates the control plate 34 back and forth, as described above.

Figure 21:
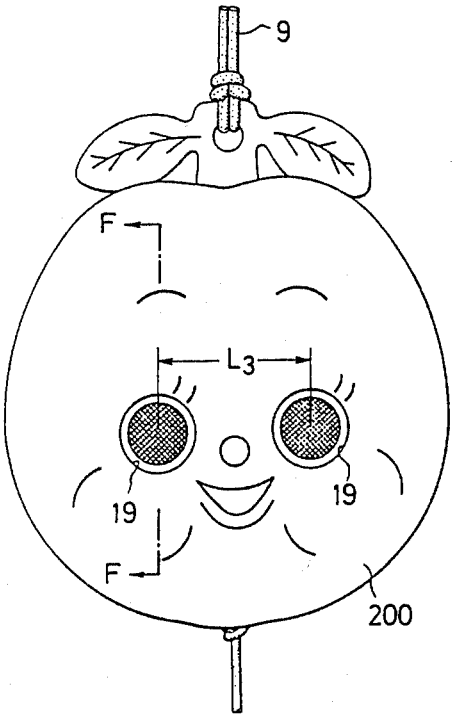
FIG. 21 is a front view showing an alternative embodiment of a case which may be used with the mechanism of the invention.

With reference now to FIGS. 21 and 22, if a front half 200 of a casing is employed having a distance between center lines of eyeholes 19 of $L_3=L_2$ ($L_2<L$, with $L_2$ being, as mentioned above, the distance between the second pins 48) the assembly of the device proceeds in the manner described above except that the eyes 33 are turned upside down from the orientation employed with the first-described embodiment. In that case, the second pins 48 are engaged with the grooves 41 of the tongues 40 projecting rearwardly from the two eyes 33. It should be noted that the presence of the projections 42 makes it easy for the assembler to correctly orient the eyeballs 33 during the assembly process.

In the toy music box described above, two different kinds of cases having different eye spacings can be employed. Also, the distances between the front and the rear halves of the casing can be varied somewhat. Accordingly, manufacturing costs can be reduced.

I claim:

1. A toy music box comprising: a casing;

a pair of movable members, at least portions of which are viewable through corresponding apertures formed in said casing, each of said movable members having an upper and lower rotary shaft affixed thereto rotatably mounted on said casing, and a tongue having a groove formed therein projecting toward an interior of said casing;

a control plate reciprocatably mounted in said casing, said control plate having first and second pairs of engaging pins affixed thereto such that said first pair of said engaging pins is fitted into said grooves of said moving members in a first orientation of said movable members and said second pair of said engaging pins is fitted into said grooves of said moving members in a second orientation of said movable members, said second orientation of said movable members being upside down from said first orientation of said movable members, and spacings between the pins of said two pairs of pins being different from one another;

a music generating mechanism comprising a movable drum and a sounding plate for sounding a tune; and means for reciprocating said control plate back and forth in response to movement of said music generating mechanism.

2. The toy music box of claim 1, wherein said tongues are offset from the center line between said upper and lower rotary shafts in the direction of said upper rotary shafts.

3. The toy music box of claim 2, wherein said first and second pairs of engaging pins are both mounted on a plate-like projection formed on a forward side of said control plate, said plate-like projection extending in a direction of reciprocal movement of said control plate.

4. The toy music box of claim 1, wherein said means for reciprocating said control plate comprises a holder plate, said control plate having first and second projecting pins affixed to a rear side thereof and projecting through elongated holes formed in said holder plate, said holder plate further having a cam gear having a cam surface abutting said first projecting pin and a spring pressing against said second projecting pin to urge said first projecting pin into engagement with said cam surface, said cam gear being engaged with an output gear of said music generating mechanism.

5. The toy music box as claimed in claim 4, wherein said casing has front and rear halves, said moving members, said control plate and said holder plate being mounted in said front half, and said music generating mechanism being mounted in said rear half.

6. The toy music box as claimed in claim 5, wherein said front half has a first pair of walls extending in a horizontal direction and a second pair of walls extending in said vertical direction, framing said apertures, said shafts of said moving members being supported in bearing grooves formed in said first pair of walls.

7. The toy music box as claimed in claim 6, wherein said front half has a support post projecting rearwardly from an inner surface thereof through an elongated hole formed in said control plate, said holder plate being fixedly secured to said support post.

8. The toy music box as claimed in claim 6, further comprising a coil spring for urging said cam gear into abutment with said output gear of said music generating mechanism.

9. The toy music box as claimed in claim 1, wherein said moving members comprise hemispherical members.

10. The toy music box as claimed in claim 9, wherein said hollow hemispherical members are each provided with a projection for identifying an up/down orientation of said hollow hemispherical members.

* * * * *